US011802430B2

(12) United States Patent
Schofield

(10) Patent No.: US 11,802,430 B2
(45) Date of Patent: Oct. 31, 2023

(54) HINGES FOR A SWIVELING REMOVABLE LID

(71) Applicant: Richard William Schofield, Redding, CA (US)

(72) Inventor: Richard William Schofield, Redding, CA (US)

( * ) Notice: Subject to any disclaimer, the term of this patent is extended or adjusted under 35 U.S.C. 154(b) by 0 days.

(21) Appl. No.: 17/682,847

(22) Filed: Feb. 28, 2022

(65) Prior Publication Data

US 2022/0282540 A1 Sep. 8, 2022

Related U.S. Application Data

(60) Provisional application No. 63/157,680, filed on Mar. 6, 2021.

(51) Int. Cl.

| | |
|---|---|
| ***E05D 7/00*** | (2006.01) |
| ***E05D 7/10*** | (2006.01) |
| ***E05D 1/06*** | (2006.01) |
| ***E05D 7/06*** | (2006.01) |

(52) U.S. Cl.
CPC ..... *E05D 7/10* (2013.01); *E05D 1/06* (2013.01); *E05D 7/06* (2013.01); *E05Y 2900/602* (2013.01)

(58) Field of Classification Search
CPC ..... E05D 7/06; E05D 7/10; E05D 7/1005; E05D 7/1011; E05D 1/06; E05Y 2900/602
See application file for complete search history.

(56) References Cited

U.S. PATENT DOCUMENTS

| | | | | |
|---|---|---|---|---|
| 2,291,667 | A * | 8/1942 | Walton | E05D 11/00 16/245 |
| 3,476,123 | A * | 11/1969 | Flax | A45D 33/28 132/315 |
| 4,673,329 | A * | 6/1987 | Kato | B25J 19/063 414/744.5 |
| 6,070,749 | A * | 6/2000 | Joulia | A45D 40/221 220/817 |
| 6,902,344 | B2 * | 6/2005 | Raak | F16C 11/0638 403/135 |
| 7,467,440 | B2 * | 12/2008 | Seidler | B65D 51/04 16/320 |

(Continued)

*Primary Examiner* — Chuck Y Mah

(57) ABSTRACT

The present invention is a novel hinge design that allows unique operation of the lid for a container, box, storage chest, ice chest or similar item. In addition to the lid being able to flip up on two hinges as is traditional, the present invention allows the lid to swivel to one side or the other, while remaining in the horizontal plane. This is accomplished, in the exemplary embodiment, by means of two inventive ball-and-socket hinges each of which can have its ball disengaged from its socket. If one ball-and-socket hinge is thus disengaged, the lid is then free to rotate horizontally around the other ball-and-socket hinge, thereby swiveling the lid to one side and effectively opening the box or container. The lid, when opened in this fashion, is amply supported by the end of the box over which it sits, and can act as a table or flat surface for organizing items as they are transferred to or from the box or container. The horizontal lid can swivel in either direction, providing broad access to either end of the container. If broader access is desired, the lid can also be completely removed by simultaneously disengaging both hinges.

4 Claims, 9 Drawing Sheets

(56) References Cited

U.S. PATENT DOCUMENTS

| | | | | |
|---|---|---|---|---|
| 7,740,147 | B1 * | 6/2010 | Gilbert | B65D 47/0885<br>220/254.3 |
| 2010/0181795 | A1 * | 7/2010 | Papanikolaou | B62D 33/037<br>296/57.1 |
| 2010/0236020 | A1 * | 9/2010 | Tsai | F16C 11/0604<br>16/224 |
| 2014/0283337 | A1 * | 9/2014 | Triebold | F16C 11/0623<br>16/224 |

* cited by examiner

HINGES FOR A SWIVELING REMOVABLE LID

REFERENCE TO RELATED APPLICATIONS

This application claims an invention which was disclosed in Provisional Application No. 63/157,680, filed Mar. 6, 2021, entitled "Swiveling Removable Hinged Lid". The benefit under 35 USC § 119(e) of the United States provisional application is hereby claimed, and the aforementioned application is hereby incorporated herein by reference.

FIELD OF THE INVENTION

The field of this invention is hinge designs and applications for hinged lids, doors or hatches, with particular application for food and beverage coolers and ice chests, or other storage boxes and containers.

BACKGROUND OF THE INVENTION

The following situations are often encountered when using an ice chest while camping, travelling, picnicking or the like.

- There is often no (or an insufficient amount of) clean, flat surface available to temporarily remove items from the ice chest either to get access to buried items in the ice chest, or to prepare food or beverages from items in the ice chest, some of which will be returned to the ice chest.
- A bag of crushed ice or ice blocks in an ice chest usually sits on top of the food and/or beverages for optimal cooling, and it frequently gets in the way when rummaging through the contents of the ice chest. There is often nowhere clean and convenient nearby to set the ice while rummaging.
- The lid of an ice chest or similar container, when flipped up, can often fall back down unintentionally causing inconvenience—particularly when in motion, such as on a boat.
- When cleaning an empty ice chest, the lid typically gets in the way, especially when turning the ice chest on its side or upside down to drain it.

The present invention, including the advanced hinge concepts disclosed herein, address these various issues.

Much of the background, figures and description here describe the use of this invention for a lid on an ice chest; however, the same principles can apply to storage chests, boxes in general, or virtually any type or shape of container or room with one or more closable openings of any shape or size, or for any two items or articles that might reasonably be connected together with hinges. For brevity and simplicity, the term box will be used generically here to refer to the box, chest, container, room or first article, and the term lid will be used generically to refer to a lid, hatch, door or second article attached by hinges. Also, the following descriptions are focused on lids swiveling in the horizontal plane; however, if the articles hinged together are in another plane—such as the vertical plane as might be the case with a door—then the second hinged article is presumed to swivel in that plane.

BRIEF SUMMARY OF THE INVENTION

In its exemplary embodiment, the present invention incorporates a pair of lid hinges, each of which performs the following three functions: 1) it allows the lid to swing up through a continuous arc in the manner of a conventional hinged lid, 2) it allows the lid to swivel from side to side in a continuous arc centered on the hinge, and 3) it can be easily disengaged or disconnected to separate the lid from the container. Function 2 only comes into play for either hinge when the other hinge has been disengaged per function 3.

PRIOR ART

There are examples in the prior art of devices that can perform one or two of the three functions described above, but no known example of a device that can simultaneously do all three functions, as required by the present invention.

While most hinges can satisfy function 1, function 2 is far less common. U.S. Pat. No. 8,572,811 (2013) by Lautenschlager describes a furniture hinge that can swivel in a horizontal manner (function 2), but it cannot swing like a conventional hinge (function 1) or be easily disengaged (function 3). As such, it has no utility for the present invention.

U.S. Pat. No. 7,000,977 (2006) by Anders describes a "slidable and hinged" door, especially of a motor vehicle. This design provides an example of a hinge that can not only swing in a conventional sense, but also has a second mode of movement—in this case, sliding. While this hinge is multifunctional like the hinges of the present invention, it would have no utility in the present invention.

There are many examples of detachable hinges that allow a hinged lid (or door) to be removed from its container (or opening), thereby satisfying function 3. For example, U.S. Pat. No. 4,200,905 (1980) by Shelby describes a detachable hinge mechanism for a luminaire (for outdoor lighting). As another example, U.S. Pat. No. 7,080,428 (2006) by Hyde describes a detachable hinge device for an automobile hood. All such detachable hinge designs can potentially meet functions 1 and 3 of the present invention, however they do not and cannot fulfil function 2.

The present invention can, as an example, utilize a ball-and-socket joint within each hinge to afford the degrees of freedom needed to satisfy functions 1 and 2. U.S. Pat. No. 7,921,513 (2011) by Burnley describes a ball-and-socket hinge assembly that can be used to attach a lid to a curved edge of a container, wherein the axes of rotation of the two hinges are not coaxial. In Burnley's invention, the ball-and-socket component gives the two hinges, when working in unison, the freedom to swing in a non-parallel way as dictated by the curved edge of the container. Burnley's hinges, however, are assembled in a permanent fashion, and are not designed or intended to be disengages per function 3 of the present invention. Furthermore, they are not designed or intended to provide any swivel capabilities per function 2, their intent being purely to allow a lid to swing upward on two non-coaxial hinges. Therefore, these hinge devises have no utility for the present invention, and do not preempt the present invention.

U.S. Pat. No. 11,136,764 (2021) by Leary describes a bracket with horizontal and vertical swivel capabilities. Basically, it is a conventional hinge with a cross-shaped key/keyway plug attachment so that the hinge can plug into (and be removed from) its mounting in a plurality of positions (in 90° increments per the cross-shaped design), thereby allowing a plurality of swing arcs for the hinge. For example, the hinge could swing north-south, and then be disengaged and repositioned in the keyway to swing east-west. The hinge swing action therein could be used to satisfy function 1 of the present invention. The separable key and keyway therein could satisfy function 3 of the present invention. The fact that the key and keyway only have discrete positions (i.e., 90° increments) does not meet the swivel requirements of function 2. In fact, Leary specifically designs the key and keyway to prevent such turning or swiveling (see, for example, Leary's claims 4, 11 and 18). Furthermore, the discrete (non-continuous) swivel feature afforded therein by the key/keyway system requires the hinge to be fully disengaged in order to be repositioned, whereas the present invention intentionally allows the lid to swivel sideways in a continuous arc without fully disengaging it from the container.

DETAILED DESCRIPTION

For most common ice chests, the hinges are either a metallic barrel hinge, or an inexpensive plastic hinge which simply relies on the flexibility of a folding plastic crease to provide the hinge action. In either scenario, the hinges typically allow approximately 100° to 120° of angular movement in a single angular plane such that the lid can be lifted up and pushed back past the vertical to rest in a slightly leaned-back position.

Figure 1:
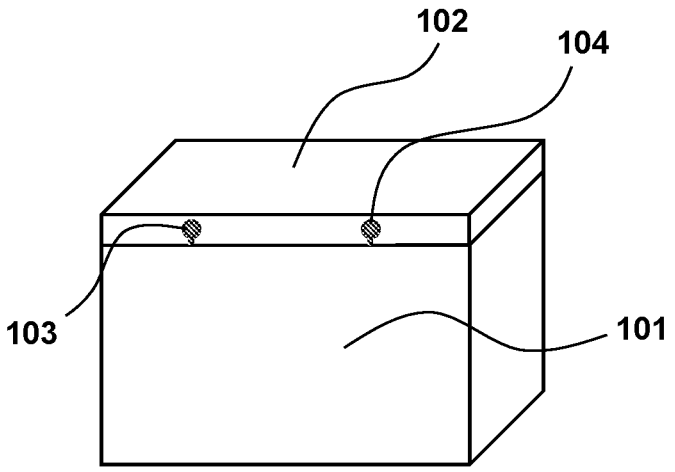
FIG. 1 shows a box with a lid and two hinges.

In one exemplary embodiment of the present invention, rather than barrel hinges or folding plastic hinges, a pair of novel ball-and-socket hinges is employed. FIG. 1 shows a simple implementation wherein a box 101 (here shown from behind) has a lid 102 attached by two ball-and-socket hinges 103, 104 on the back side of the box.

Figure 2:
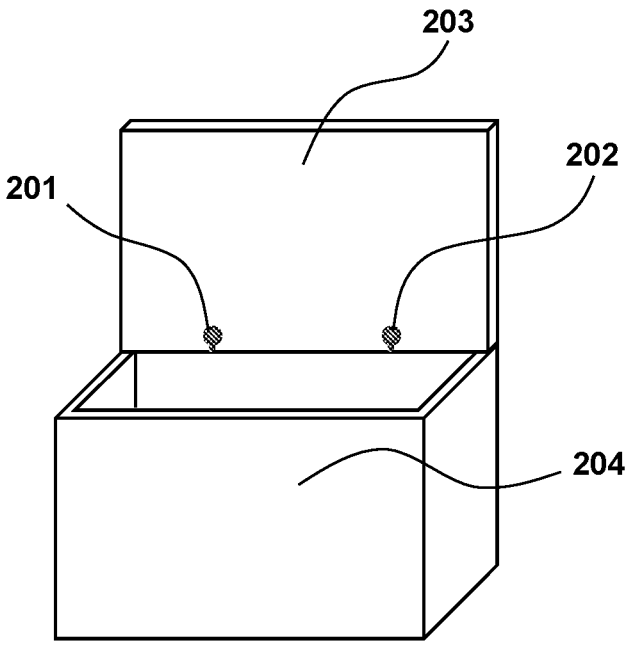
FIG. 2 shows a box with its lid flipped up in the usual fashion of hinged lids.

These ball-and-socket hinges are designed to allow the lid to lift in the traditional manner, as shown in FIG. 2 (here shown from the front). The two ball-and-socket hinges 201, 202 allow the lid 203 to lift up through hinge action to the vertical position (or slightly beyond) thereby allowing open access to the box 204. In that sense, the hinges of the present invention provide all of the utility of traditional barrel or folding hinges.

Figure 3:
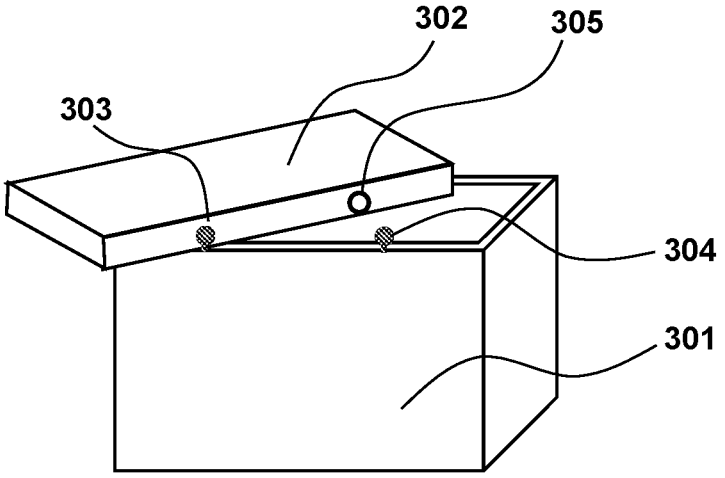
FIG. 3 shows a box with its lid slightly swiveled to the side.

Unlike traditional hinges, however, this invention provides two new and unique modes of operation for the lid. In the first unique mode, shown in FIG. 3, the box 301 (once again shown from behind) has been partially opened by swiveling the lid 302 to one side. This relies on one ball-and-socket hinge 303 remaining in its usual engaged state with its ball component fixed inside its socket component, while the second hinge has been separated such that its ball component 304 is disengaged from its socket component 305. It is an essential part of this invention that at least one and preferably both ball-and-socket hinges can be separated in this way without the use of tools, and by the application of only a small to moderate amount of force, as might be exerted by hand by a typical child or adult.

With the second ball-and-socket hinge 304, 305 disengaged, the first ball-and-socket hinge 303 can keep the lid 302 firmly anchored to the box 301 while allowing it to swivel easily and freely in the horizontal plane.

Figure 4:
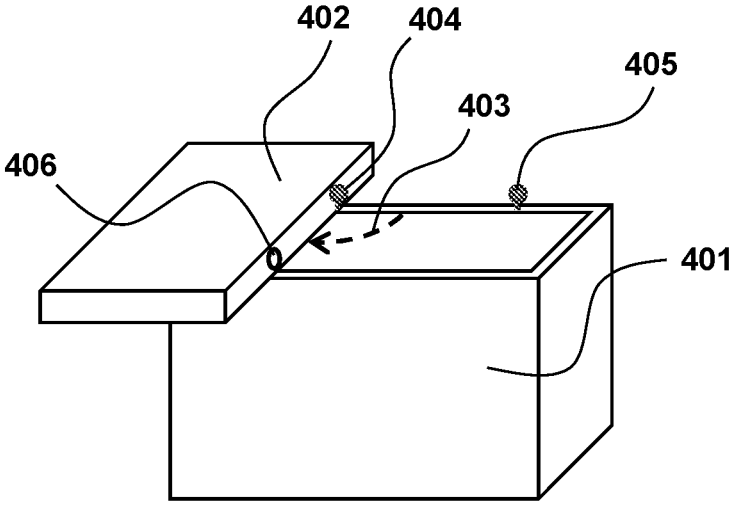
FIG. 4 shows a box with its lid swiveled 90 degrees to the side.

FIG. 4 shows the same unique operation of the box 401 (now viewed from the front again) where the lid 402 has been swiveled through approximately 90° 403 around one hinge 404, which remains in its engaged state. The second hinge remains in its disengaged state (as was shown in FIG. 3), with its ball component 405 and socket component 406 now far apart. In this state, the lid 402 only covers a small portion of the opening of the box 401, allowing a high degree of access to the contents of the box. The engaged hinge 404 keeps the lid 402 firmly anchored to the box 401 such that the lid 402 becomes a stable horizontal surface, which provides a makeshift table or flat surface as might be used, for example, for food or beverage preparation or for temporarily stowing a large bag of ice.

Optional tabs or pegs protruding down from the lid (for example, on the underside of the point identified as 402) could be employed to hinder the lid from being swiveled too far, such that it overhangs the box to such an extent that it is no longer a stable surface. In a similar fashion, if the ball component of each ball-and-socket hinge protrudes down from the lid rather than up from the box, then it can act to prevent the lid from being swiveled too far. In practice, the lid should not be swiveled more than about 100° to 135° depending on the geometry of the lid and placement of the hinges.

The lid can be closed again by swiveling in the opposite direction and reengaging the ball-and-socket hinge components 405, 406 via a small to moderate application of force. With both hinges now engaged, the lid could then, if desired, be swiveled in the opposite direction by disengaging the other hinge 404, thereby giving full access to the opposite end of the box.

In this fashion, the present invention addresses the need to have additional flat surface available for food and beverage preparation, or for temporary stowage of bags of ice. In essence, the flat lid of the cooler can be used as a preparation surface even when the cooler is open. It also addresses the problem where a cooler lid can inadvertently fall and close when in use, as the swiveled lid is in a stable position and cannot fall.

Figure 5:
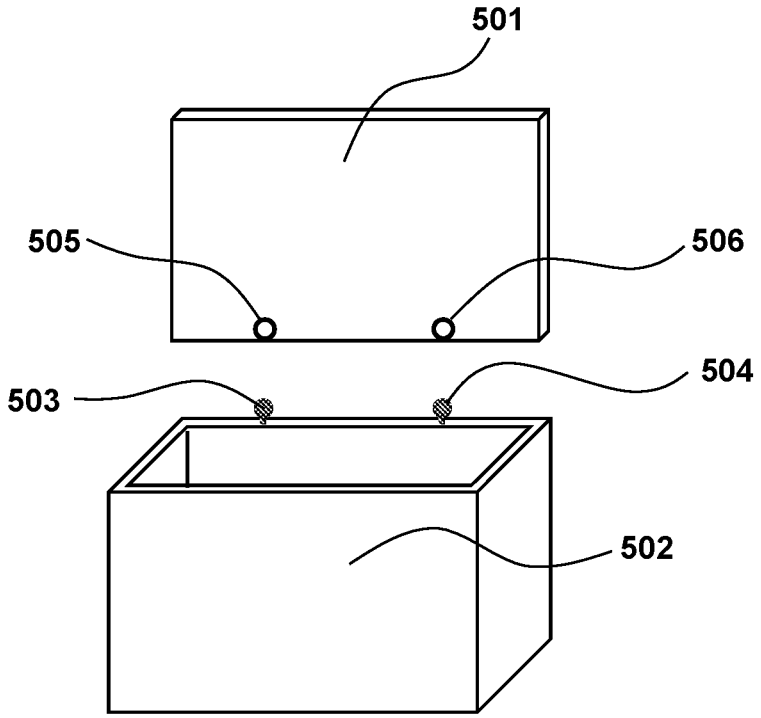
FIG. 5 shows a box with its lid completely removed.

The second unique mode of lid operation of the present invention is shown in FIG. 5. Here, the lid 501 is removed completely from the box 502 by disengaging both ball components 503, 504 from their respective socket components 505, 506. This can be accomplished, for example, using either of the following options:

1. While the lid is in its horizontal position (as was shown in FIG. 1) each hinge can be disengaged horizontally—simultaneously or in turn—thereby removing the lid whilst keeping it in the horizontal plane.

2. While the lid is in its flipped-up position (as was shown in FIG. 2) each hinge can be disengaged—simultaneously or in turn—by either lifting the lid with sufficient force, or by pushing it back past its "fully open" upright position, thereby using leverage to disengage the hinges.

Removability of the lid is a strongly preferred (but not required) design feature of the present invention, and while either mode of lid removal just described could provide the desired functionality, the availability of both options gives the most utility. Option 1 becomes particularly useful when, say, food and beverages have been prepared on the swiveled-open lid, and the second hinge is then disengaged in order for the lid to be completely removed so it can become a tray for serving said food and beverages. Option 2 becomes particularly useful either when the lid is already in its flipped-up position and full removal is an afterthought, or when it is desirable to take advantage of the leverage afforded by pushing it back past its "fully open" position.

With the lid off, easy access to the box can be granted from all sides without hinderance from a raised lid. This could prove useful, for example, for a large gathering of children all seeking access to a cool beverage from all sides of an ice chest. Also, with the lid removed, an ice chest can be more-easily handled for cleaning and drying, correcting one of the deficiencies of current cooler lid designs.

The lid can be reattached by simply laying it flat on the box with the hinge components lined up, and pushing each hinge back together.

The key to the present invention is hinge design. As discussed, the hinges should satisfy three basic requirements or functions.

1. When both hinges are in their engaged state, they should allow the lid to flip up to an upright (or slightly-beyond-upright) position and remain there held securely in place.

2. When a first hinge has had its ball and socket components disengaged, the second hinge should allow the lid to swivel in the horizontal plane around that second hinge, at least until the box is open enough for practical utility. Movement in planes other than the horizontal may also be achievable, but are not necessary.

3. At least one hinge (but most preferably both) should be able to have its ball and socket disengaged by the modest application of force, thereby temporarily breaking the hinge apart. Correspondingly, the hinge should also be able to be reengaged by the modest application of force, and stay engaged until the disengagement force is once again applied. If both hinges can be disengaged in this way, the lid can be swiveled in either direction, and the lid can also be completely removed.

Figure 6:
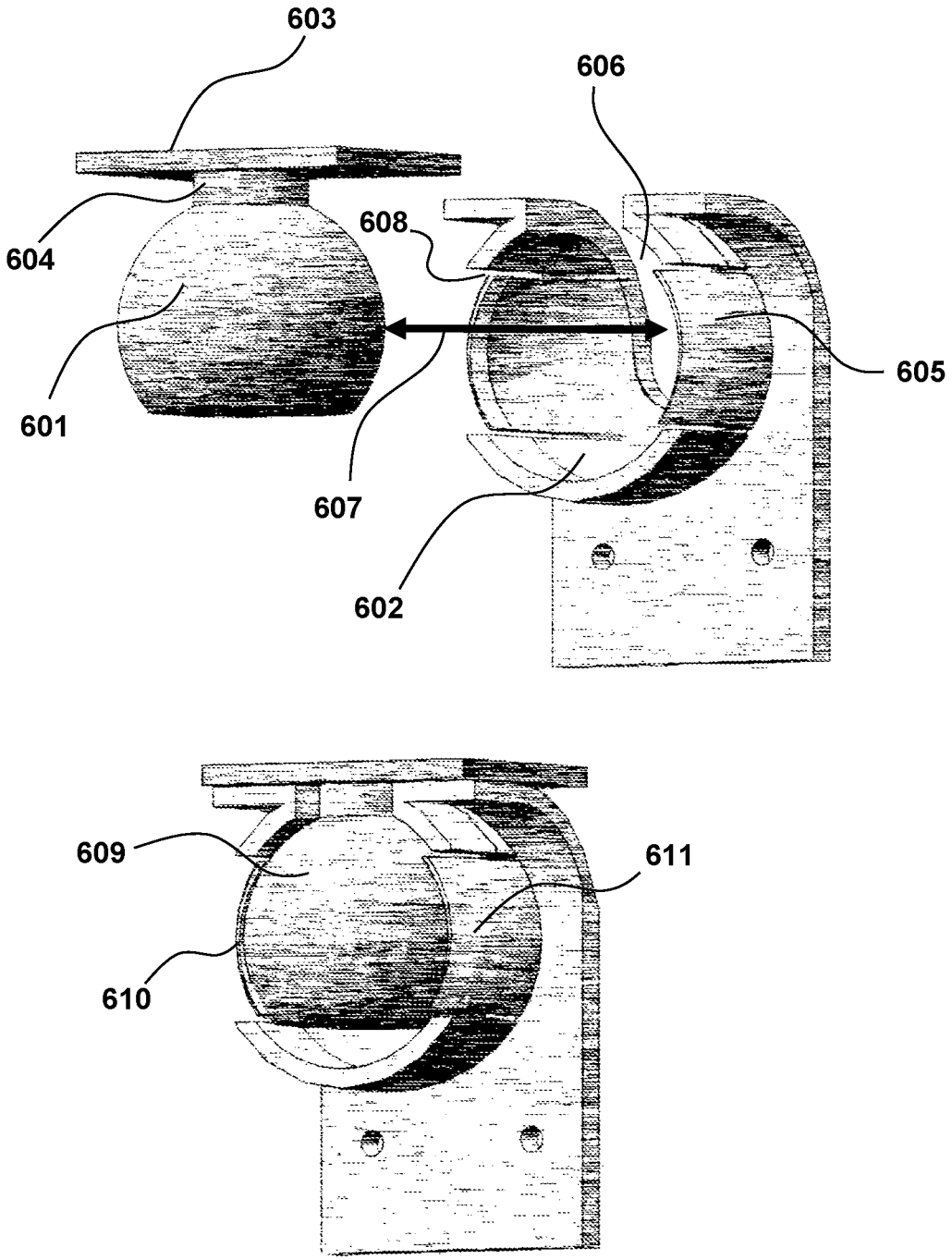
FIG. 6 shows the components of an exemplary ball-and-socket hinge for the present invention.

An example ball-and-socket hinge design that meets these three functional requirements is shown in FIG. 6. In this example, the ball component 601 (here shown truncated slightly at the bottom) is designed to protrude down from the lid, and the socket component 602 is designed to be embedded in the wall of the box at a height appropriate to receive the ball 601 when the lid lies flat on top of the box. One skilled in the art could flip these orientations so that the ball sticks up from the box and the socket is embedded in the lid, as was shown in FIGS. 1 through 5.

The ball component in FIG. 6 has a connector plate 603 to attach it to the lid. A short cylindrical connector rod 604 connects the ball 601 to that plate 603.

The socket 602, in this design, has two flexing sides 605 that can flex apart to allow the ball to be disengaged from or reengaged into the socket. While engaged, these flexing sides wrap around the ball past its vertical equator, thereby holding the ball securely within the socket. The geometry and amount of flexure of these sides 605 largely controls the force required to disengage or reengage the ball-and socket hinge components.

As shown in FIG. 6, there is a wide slot 606 cut into the back of the socket 602 which is wide enough to accommodate the connector rod 604, thereby allowing the ball 601 to rotate backwards whilst inside the socket.

The flexing sides 605 shown in FIG. 6 are separated from the rest of the socket 602 by means of narrow slots 608, facilitating their flexure to either side. Such slots may be problematic in that water or insects may utilize them to gain access to the internal spaces of the box or lid where the sockets are mounted. An alternative design concept molds the entire socket into the box or lid utilizing a flexible, elastic polymer that provide sufficient flexure without the need for such slots.

In a second view in FIG. 6, the ball 609 is shown fully engaged in the socket, with the flexing sides 610, 611 securely holding it in place.

Figure 7:
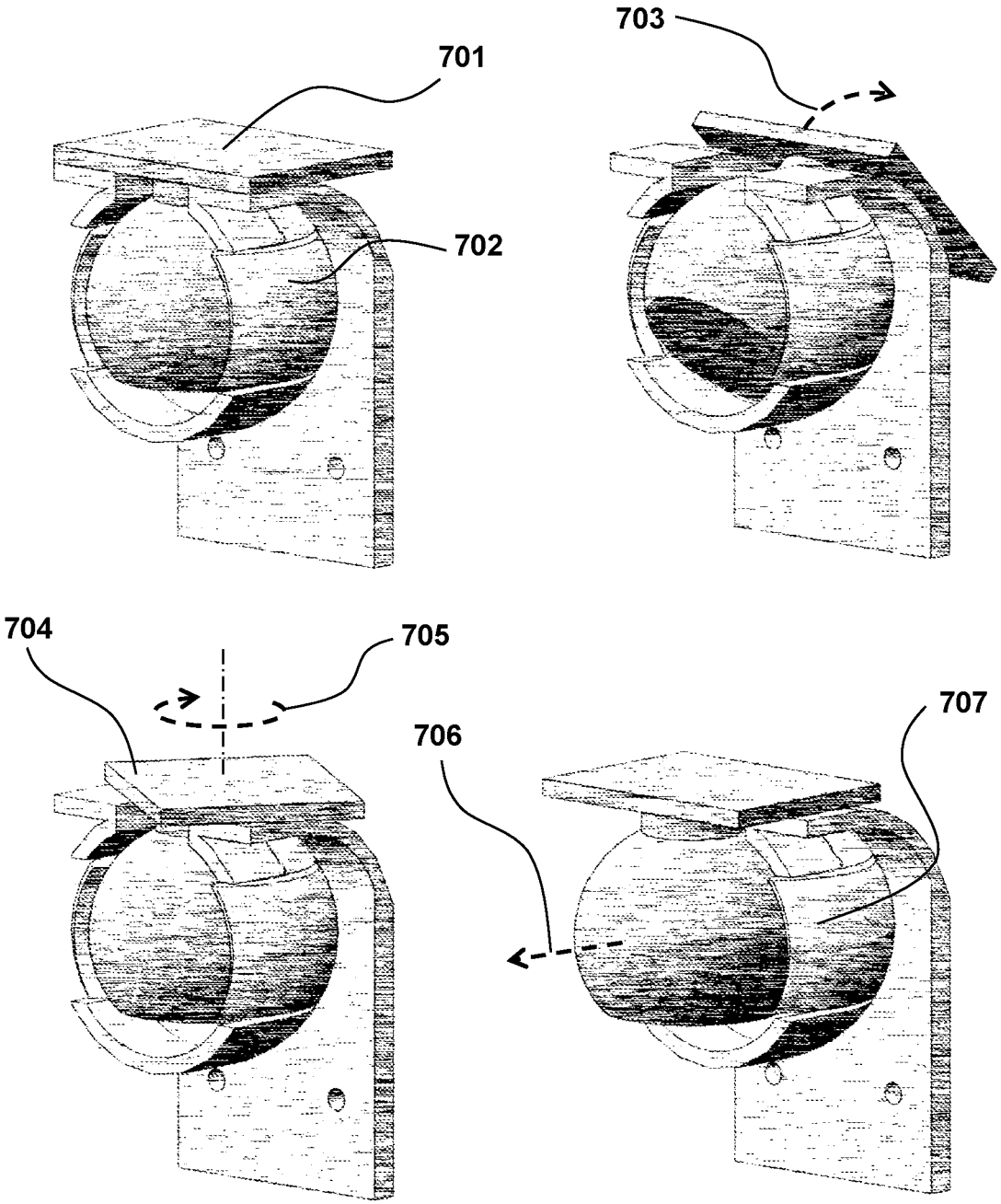
FIG. 7 shows some of the possible motions of the exemplary ball-and-socket hinge of the present invention.

FIG. 7 shows the hinge design of FIG. 6 performing its three required functions. Initially, when the lid of the box is closed, both hinges would have their ball component 701 engaged within their socket component 702. The ball component 701 could be mounted to the underside of the lid protruding downwards, while the socket component 702 could be embedded in the top of the back wall of the box. Alternately, that arrangement could be flipped vertically.

With both hinges engaged, they can both allow their ball component to rotate backwards 703 (utilizing the slot 606 in the back of the socket), thereby flipping the lid up and open, satisfying function 1.

With one such hinge disengaged, the remaining engaged hinge could allow the ball component 704 to rotate in a horizontal plane 705, thereby satisfying function 2.

The application of pressure in an outward direction 706 could allow the two sides 707 of either socket component to flex outwards, thereby allowing the disengagement (and later reengagement) of the ball and socket, satisfying function 3.

Figure 8:
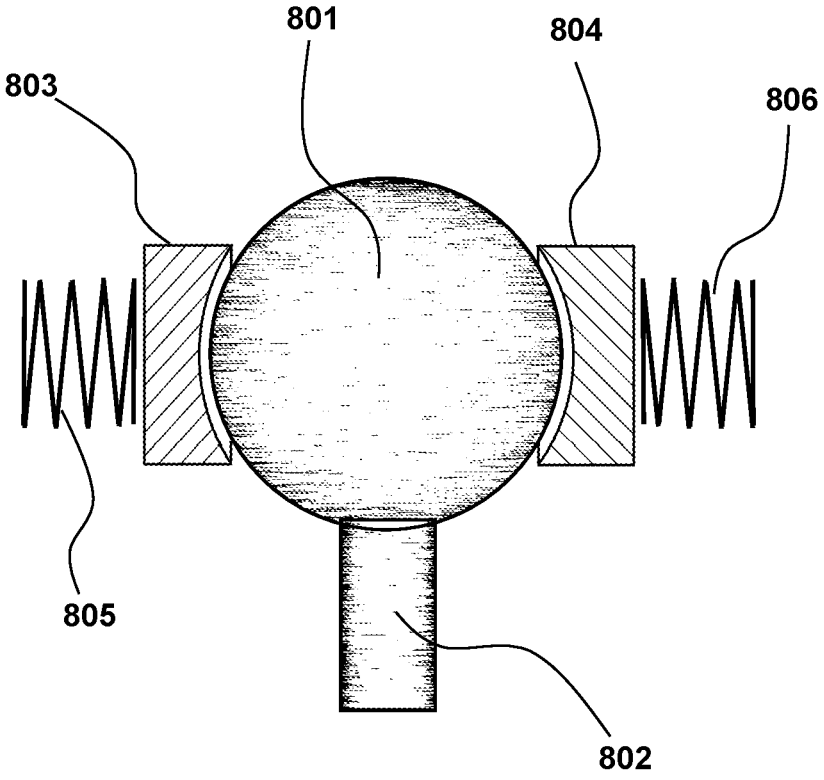
FIG. 8 shows a second example style of ball-and-socket hinge for the present invention.

FIG. 8 shows another concept in hinge design for the present invention. Here, the ball component 801 is attached to a connecting rod 802 as before. The socket component is composed of two concave pressure plates 803, 804 (shown here in cross-section) pressed against the ball 801 be means of, for example, springs 805, 806. This allows each ball-and-socket hinge to spin and rotate in a wide range of planes and angles. It also allows the ball to be disengaged from the socket by the application of force in a wide range of directions, provided the direction of the force is more-or-less at a normal angle to the pressure plates 803, 804.

Figure 9:
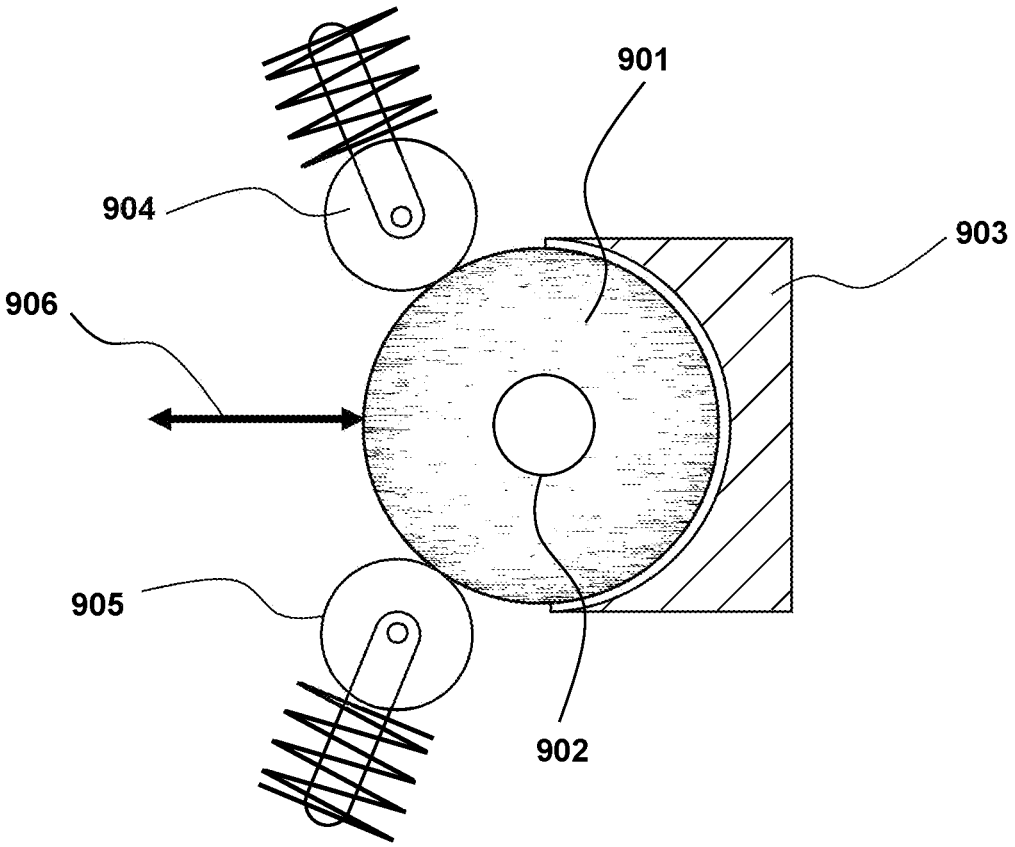
FIG. 9 shows a third example style of ball-and-socket hinge for the present invention.

FIG. 9 shows yet another concept in hinge design. Here, the ball 901 is attached to a rod 902 as before (here shown in an orthographic projection plan view with the rod 902 pointing up). The socket is comprised of a hemispherical concave receptacle 903 (shown here in cross-section). The ball is kept firmly in place within the socket by two spring-loaded cylindrical rollers 904, 905. While engaged in this fashion, all of the required ranges of motion of the ball-and-socket joint are available. If the ball is moved with modest force in an inward or outward direction 906, the rollers are forced back against their springs to allow engagement or disengagement of the two hinge components.

The three hinge design concepts of FIGS. 6, 7, 8 and 9 have been successfully demonstrated, and many similar designs are foreseen. Hinge designs may also be developed that are not of ball-and-socket design, but that still offer the same or similar functionalities satisfying the three basic requirements of this invention. For example, barrel hinges with two sets of barrels mounted perpendicularly may be effective.

Still further designs may employ a ball-and-socket for the required ranges of motion and rotation, but may keep the ball-and-socket fully engaged at all times, and unplug the hinge by a secondary means in order to satisfy the engagement/disengagement function.

The figures and descriptions here have focused on the present invention being used to attach a lid to a box, for example, for the lid on a food-and-beverage ice chest or cooler. The same hinge designs can be used for any two articles that might be hinged together, and which might be arranged in any orientation. Other examples include hinged doors, hatch covers, gates, shutters, foldable furniture components, and so on.

In another foreseen application, a plurality of matching balls and sockets might allow a first hinged article to be attached to a second article at multiple locations, with swing and swivel arcs in multiple planes.

I claim:

1. A dual hinge assembly for removably attaching a lid to a container, wherein:

the container is a box in the form of a rectangular prism with an open top, said container comprising a horizontal rectangular base with four sides, said base having a length corresponding to its two long sides and a width corresponding to its two short sides, and further comprising four walls rising vertically from the four sides of the base, the four walls comprising a front wall on one long side of the base and a back wall the other long side, and a left wall and a right wall on the two short sides, said four walls having a common fixed height and each of the four walls having an exposed top edge, said top edges bounding the open top of the container, and the lid is rectangular in shape with the same length and width as the base, said lid, when in a horizontal position, having a top surface that is flat and a bottom surface that is flat, said lid having a closed position wherein said closed lid is horizontal and covers the open top of the container, and wherein said closed lid has a back edge that aligns with the top edge of the back wall of the container, and wherein the bottom surface of said closed lid is in physical communication with the top edges of the four walls, and wherein the weight of said closed lid, inclusive of any matter resting on its top surface, is borne by the top edges of the four walls, the hinge assembly comprising two reversibly engageable ball-and-socket hinges, being a lefthand hinge and a righthand hinge, said two hinges connecting the back edge of the closed lid to the top edge of the back wall, wherein the lefthand hinge is positioned on the back edge of the closed lid at a distance from the left wall, and the righthand hinge is positioned on the back edge of the closed lid at the same distance from the right wall, said distance being equal to approximately half of the width of the lid, and wherein each hinge comprises a ball component and a socket component, the ball component comprising a ball mounted on a stem rising vertically from the top edge of the back wall, the ball being spherical and the stem being cylindrical with a diameter that is smaller than the diameter of the ball, and the socket component comprising a hemispherical recess set into the back edge of the lid, said hemispherical recess having a circular open face that is oriented vertically and faces backwards when the lid is in the closed position, such that for each hinge, the ball of its ball component cospherically mates with the hemispherical recess of its socket component when the lid is in the closed position, and for each hinge, the socket component further comprises a slot in the bottom of its hemispherical recess to accept the stem of the ball component during such cospherical mating, and wherein each hinge has two possible states, being an engaged state wherein the ball of its ball component is cospherically mated with the hemispherical recess of its socket component, in which engaged state said hinge's socket component can rotate relative to its ball component around the vertical axis of its stem, and a disengaged state wherein the ball of its ball component is not cospherically mated with the hemispherical recess of its socket component, and each hinge further comprises a securement mechanism for releasably securing its ball within its hemispherical recess when said hinge is in the engaged state, said securement mechanism comprising at least one flexing member that provides a point of slidable contact on the surface of said ball to press said ball into said hemispherical recess when said hinge is in the engaged state, wherein said flexing member has sufficient flexure to move aside when said ball is forcibly withdrawn from said hemispherical recess, thereby allowing said hinge to transition from the engaged state to the disengaged state, and wherein said flexing member has sufficient flexure to move aside when said ball is forcibly inserted into said hemispherical recess, thereby allowing said hinge to transition from the disengaged state to the engaged state, the hinge assembly being operable in a lefthand direction and a righthand direction, wherein in the lefthand direction, the lefthand hinge is in the engaged state and the righthand hinge is in the disengaged state allowing the lid to swivel forwards and to the left in an arc of at least 90° around the vertical axis of the stem of the lefthand hinge, at which point the lid is positioned sideways over the left wall, and the open top of the container is partially exposed adjacent to the right wall, and wherein in the righthand direction, the righthand hinge is in the engaged state and the lefthand hinge is in the disengaged state allowing the lid to swivel forwards and to the right in an arc of at least 90° around the vertical axis of the stem of the righthand hinge, at which point the lid is positioned sideways over the right wall, and the open top of the container is partially exposed adjacent to the left wall, and wherein, while operating in either the lefthand direction or the righthand direction, the lid remains in a horizontal plane, and the lid remains in physical communication with portions of the top edges of at least two of the four walls, and the weight of the lid, inclusive of any matter resting on its top surface, is uninterruptedly borne by portions of the top edges of at least two of the four walls.

2. The hinge assembly of claim 1 wherein the lid and container are any two articles to be connected by hinges with each article having at least one straight edge on which to mount the hinges.

3. The hinge assembly of claim 1 wherein at least one of the ball-and-socket hinges is inverted such that its ball component protrudes down from the lid and its socket component is set into the top of the back wall with the open face of its hemispherical recess facing forwards.

4. The hinge assembly of claim 1 wherein either ball-and-socket hinge can be disconnected from at least one of the lid or the container, to provide the required functionality of disengagement without disengaging the hinge's ball component from its socket component.

* * * * *